US006406022B1

(12) United States Patent
Nadibaidze

(10) Patent No.: US 6,406,022 B1
(45) Date of Patent: Jun. 18, 2002

(54) METHOD OF PLAYING A ROULETTE-TYPE MASS AMUSEMENT GAME HAVING A BETTING FIELD WITH ZODIAC SIGNS

(76) Inventor: Tamazi G. Nadibaidze, Zadonsky proezd, d. 16, kor. 1, kv. 378, 115580 Moscow (RU)

( * ) Notice: Subject to any disclaimer, the term of this patent is extended or adjusted under 35 U.S.C. 154(b) by 0 days.

(21) Appl. No.: 09/554,247

(22) PCT Filed: Nov. 5, 1998

(86) PCT No.: PCT/RU98/00366

§ 371 (c)(1),
(2), (4) Date: Jul. 13, 2000

(87) PCT Pub. No.: WO00/29082

PCT Pub. Date: May 25, 2000

(30) Foreign Application Priority Data

Nov. 11, 1997 (RU) ..... 97118623

(51) Int. Cl.[7] ..... A63F 5/00
(52) U.S. Cl. ..... 273/274; 273/138.1; 273/146
(58) Field of Search ..... 273/274, 146, 273/142 R, 142 D, 142 E, 142 F, 142 G, 142 H, 142 HA, 138.1

(56) References Cited

U.S. PATENT DOCUMENTS 1,520,697 A * 12/1924 Carlson ..... 273/142 R
4,247,114 A 1/1981 Carroll
4,688,803 A 8/1987 Ollington
4,778,186 A 10/1988 Dudley

FOREIGN PATENT DOCUMENTS

FR 2316986 * 2/1977 ..... 273/274
GB 949733 * 2/1964 ..... 273/274
GB 2019 228 A 10/1979
RU 209 02 32 C1 9/1997

OTHER PUBLICATIONS

The Zodiac–Chuck–A–Luck Game, Vincent J. Picataci, 1974.*

* cited by examiner

*Primary Examiner*—Benjamin H. Layno
(74) *Attorney, Agent, or Firm*—Sughrue Mion, PLLC

(57) ABSTRACT

The method of mass amusement uses the stake field simulating a roulette-type betting field with various-color stake squares with various-color information marks from 1 to 36 formed thereupon and the twelve Zodiac signs in the stake squares with digital information marks 1, 2, 3, 5, 7, 11, 13, 17, 19, 23, 29, and 31. Also formed is a flat image of a stationary roulette wheel having 36 main sectors and one or two additional sectors, with each main sector to contain, first, the images of digits from 1 to 36 with the images of the twelve Zodiac signs in the places of location of the prime numbers 1, 2, 3, 5 ,7, 11, 13, 17, 19, 23, 29, and 31, and, secondly, two images of the hexagonal die with information marks being various number of spots: from one to six. Then, the players place their bets on the stake squares of the stake field, the procedure to be followed by choosing two pairs of random gambling indices by means of double simultaneous casting of two hexagonal dice.

1 Claim, 3 Drawing Sheets

METHOD OF PLAYING A ROULETTE-TYPE MASS AMUSEMENT GAME HAVING A BETTING FIELD WITH ZODIAC SIGNS

FIELD OF THE INVENTION

The invention concerned belongs to methods of social amusement, to be more precisely, it belongs to mass gambling games using dice to throw.

BACKGROUND OF THE INVENTION

A mass amusement method is known, according to which players place their stakes on motley stake squares of the stake field with formed motley information, simultaneous throwing of a pair of dice with equal number of faces, to come to rest at random on a flat surface, to be followed by comparing the information formed with the stakes to score the winner (U.S. Pat. No. 4,688,803).

The disadvantage of the known method seems to be rather low amusement value related to unequivocal correspondence of each pair of randomly chosen gambling indices with digital information marks of the stake field.

Also known is a mass amusement method taken as the prototype and including formation of the stake field with various-colour stake zones with digital information marks from 1 to 36, formation of a revolving flat image of the roulette field with 36 main sectors with digital information marks similar to those formed on the stake squares of the stake field, and two additional sectors, players betting on the stake squares of the stake field, choosing a random gambling index, basing on which the winner is scored (U.S. Pat. No. 4,077,631).

A disadvantage of the known method is its rather low entertaining value related to selection of only one random gambling index, as well as to a small number of stakes.

SUMMARY OF THE INVENTION

The invention is based on the task to increase the entertaining ability of the mass amusement method concerned.

The mission can be accomplished by the fact that the mass amusement method consisting in formation of the stake field with various-colour stake squares with digital information marks from 1 to 36 depicted thereupon, formation of the image of the roulette field with 36 motley main sectors with digital information marks from 1 to 36 depicted thereupon in random sequence, and at least one additional sector, player's placing their bets on the stake squares of the stake field, choosing a random gambling index, based on which the winner is to be scored, according to the invention, with the twelve Zodiac signs being placed on the main sectors of the roulette field and in the place of location of prime numbers 1, 2, 3, 5 ,7, 11, 13, 17, 19, 23, 29, and 31, as well as two images of the hexagonal die's face, with the main sectors of the roulette field being divided into six similar groups, with the first one containing the first image of the die face with one spot, the second group containing the first image of the die face with two dots, the third—the first image of the die face with three spots, the fourth—the first image of the die face with four spots, the fifth—the first image on the die face with five spots, and the sixth—the first image of the die face with six spots; and the second image of the die face in each group of the main sectors is formed as a sequence of the die face, beginning from the image of the die face with one spot and ending in the image of the face with six dots thereon, images of the twelve Zodiac signs are formed in the stake squares of the stake field with digital information marks 1, 2, 3, 5 ,7, 11, 13, 17, 19, 23, 29, and 31, with choosing the random gambling indices two times, in doing so the random gambling indices are to at least once chosen by simultaneous throwing of two hexahedral dice differing in appearance and marked with from one to six spots.

In doing so, the random gambling indices are to be chosen by double simultaneous casting of two hexahedral dice differing in appearance, with the first simultaneous throwing of the both dice showing the first of the 36 possible combinations of the die-face images depicted in the main sectors of the roulette field, or one of the twelve Zodiac signs also depicted in the main sectors of the roulette field, the immediately following simultaneous casting of the same dice yielding the second of the 36 possible combinations of the die-face images depicted in the main sectors of the roulette field, or the same or another of the twelve Zodiac signs depicted in the main sectors of the roulette field.

The determining factor in the formation of the stake field is herein the number "twelve". The thirty six playing sectors on the stake field form the stake as three rows twelve numbers each. These rows are divided into three sectors (also being the stake zones) each of which also containing twelve digits.

The number of the Zodiac signs also equals twelve.

The row of the paying numbers from 1-through-36 includes prime numbers which divide to themselves only. These are numbers 1, 2, 3, 5 ,7, 11, 13, 17, 19, 23, 29, and 31. Both the roulette, and the stake-to-be fields these numbers are divided equally by colour, i.e., the six red and the six black. Therefore, the prime numbers from the point of view of all types of the stakes are sure to be equally probable to cast.

Hence, beside the appearance of new single stakes to appear, placing the Zodiac signs in the areas defined by the prime numbers (the stake field being the commonly accepted graphic system in the European and American roulettes), will organically born the so-called "stake zones of Zodiac" (in addition to the usual "red", "black" "first eighteen", etc.): "red Zodiac", black Zodiac", and "Zodiac". They are convenient to be placed on the stake field near the edge of the roulette table, with the stakes for the first two zones will present clams for payoff when cast for any "red" or any "black" Zodiac signs, and with the third zone—of any of the twelve Zodiac signs, with the gains for these stakes being equal to those for the six or twelve numbers.

BRIEF DESCRIPTION OF DRAWINGS

Following are drawings to explain the method, where.

LIST OF DESIGNATIONS ON THE DRAWINGS

Figure 1:
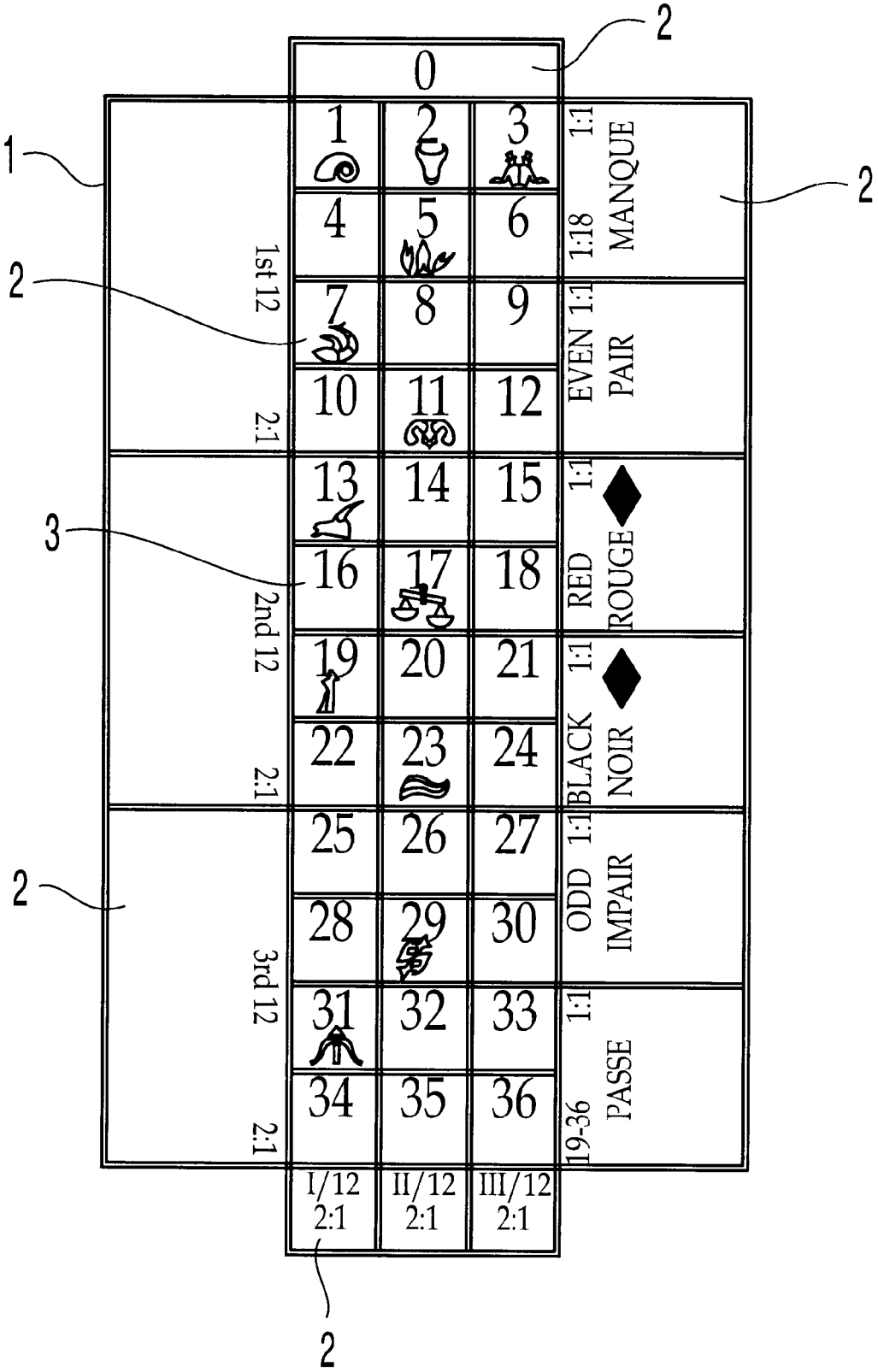
FIG. 1 depicts the stake field.
Figure 2:
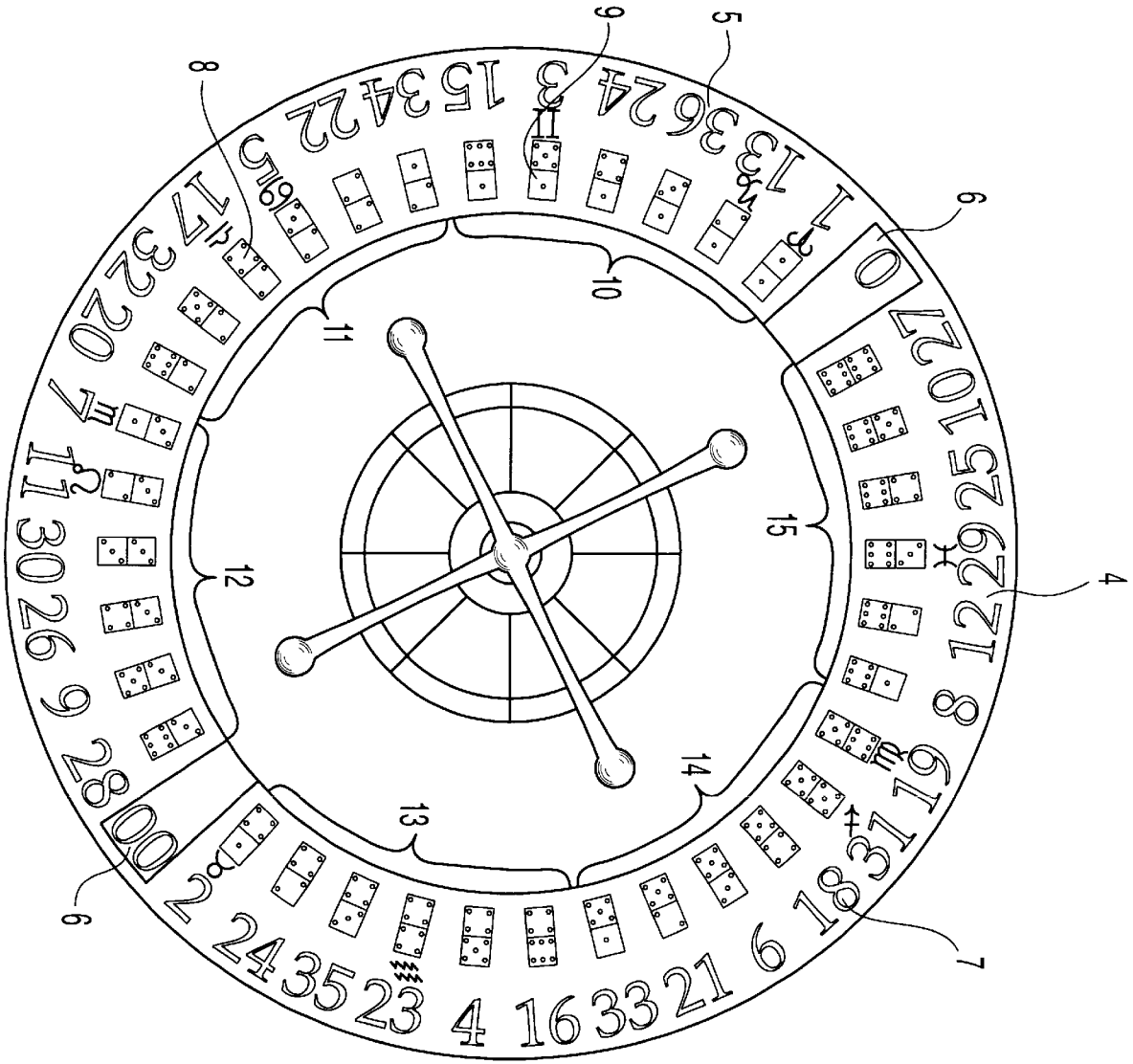
FIG. 2 is the roulette field.
Figure 3:
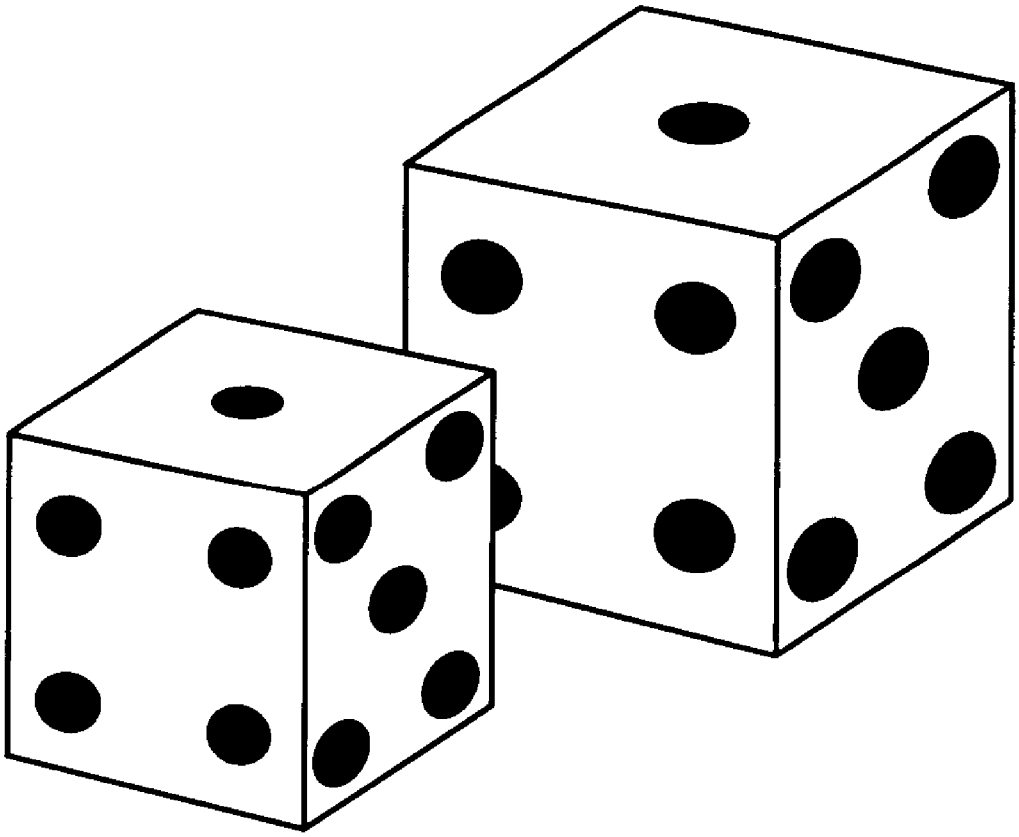
FIG. 3 depicts two dice.

1.—stake field.
2.—stake field squares.
3.—digital information marks.
4.—roulette field.
5.—main sectors of the roulette field.
6.—additional sectors of the roulette field.
7.—digital information marks.
8.—first image of the die's face.
9.—second image of the die's face.
10, 11, 12, 13, 14, 15—groups of the roulette field main sectors.
16—image of one of the Zodiac signs.

DETAILED DESCRIPTION OF THE INVENTION IN THE CLAIMS

Performing the proposed method of mass entertainment is accompanied by observing the demands similar to those imposed by carrying out the measures relating to the roulette playing, i.e., provision of equal probability of the numbers to be cast (gambling indices).

Prior to implementing the method, the croupier chooses the "casino's number" (any number from 1 to 36). Choosing the "casino's number" may be done either randomly, or by using any means of choice of a random number from a plurality of equal-probability numbers.

Then, the stake field (1) is formed with motley stake squares (2) with various-colour information marks (3), formed thereupon, e.g., digits from 1 to 36, as well as the twelve Zodiac signs (16) in the squares of the stake field with digital information marks 1, 2, 3, 5 ,7, 11, 13, 17, 19, 23, 29, and 31.

Additionally, the image of the stationary roulette field (4) is formed to contain 36 main (5) and one or two additional (6) sectors. Each main sector (5) of the roulette field (4) is to contain random-sequence various-colour information marks (7), for example the digits similar to the information marks (3) formed on the stake squares (2) of the stake field (1). Additionally, the images of the twelve Zodiac signs (16) are formed in the sector of the roulette field (4) with information marks 1, 2, 3, 5 ,7, 11, 13, 17, 19, 23, 29, and 31. Besides, each main sector (5) of the roulette field (4) shall contain two images (8, 9) of the hexahedral die with information marks as various number of spots, and the main sectors (5) of the roulette field (4) are divided into six similar groups (10, 11, 12, 13, 14 and 15). The first group (10) contains the first image (8) of the die's face with one spot, group two (11) contains the first image of the die's face with two spots, group three (12) contains the first image of the die's face with three spots, etc. The second images (9) of the die's face to be formed in each group of the main sectors (5) of the roulette field (4) are to represent a sequence (row) of the die's six faces with the face's image beginning from the image of one spot and ending by the image of the die's face with six spots.

Formation of the additional sector (6) "0" of the flat stationary roulette field (4) is designed for bets to be made for the European roulette, and the additional sectors "0" and "00" —for bets to be made for the American roulette.

After the above-described operations, the players place their bets on the stake squares (2) of the stake field (1) with motley information marks (3) formed thereupon.

Then, the croupier carries out selection of two pairs of random gambling indices by means of twice simultaneous casting of the two dice differing in appearance. Prior to it, both the croupier, and the players must agree as to which of the dice would refer to a particular sequence of the dice's faces images formed in the main sector (5) of the roulette field (4). Resulting therefrom, the first simultaneous throwing of the two dice is to yield the first of the 36 possible combinations of the dice' faces images formed in the main sectors of the roulette field, and the immediately following simultaneous casting of the same dice is to yield the second of the 36 combinations of the dice faces images.

Based on the results of casting the dice, the winner is determined, for example, as follows.

If the first throwing has showed any number except the "casino's number", the second throwing will show the prize number for the players.

If the first throwing has showed the "casino's number", and the second not, the winners would be those players having made their stakes to "0".

If both castings yielded the "casino's number", replaying is to be followed.

In case of the American option with the "0" and "00" stakes, two numbers of the casino are to be preliminarily determined.

If the first throwing yields any number except the "casino's numbers", the second casting will show the winning number for the players.

If the first pair of the chosen random gambling indices yields the first "casino's number", and selecting the second pair yields any number except the "casino's numbers", the winners would be those players having bet on "0".

If the first pair of the chosen random gambling indices yields the second "casino's number", and selecting the second pair yields any number except the "casino's numbers", the winners would be those players having bet on "00".

If both castings resulted in the "casino's number" (any), replaying is to be followed. A stake "F" ("fortune") might be proposed, which will win if only two "casino's numbers" have been cast in succession.

The Zodiac signs may also participate in the game as additional stakes, as the "casino's numbers", and in the bids for the "stake Zodiacal zones".

The "casino's number may be not appointed, but determined by means of a preliminary cast of two dice.

Formation of the Zodiac signs on the stake field squares makes it possible not only to increase the number of stakes, but to introduce particular astrological interpretations, which would undoubtedly increase the entertaining capability of the mass amusement method proposed.

Industrial Applicability

The proposed method of social amusement can be used in both specially equipped premises, and in usual ones. In other words, it may successfully be referred to both the in-, and out-of-door games.

What is claimed is:

1. A method of playing a roulette-type mass amusement game comprising the steps of:

providing at least two hexahedral dice, each hexahedral die having faces marked with one to six dots, and each hexahedral die differing in appearance;

providing a betting field comprising thirty six stake squares, and one or two additional stake squares distinguishable from the thirty-six stake squares, each stake square having a different digital informational mark from 1 to 36 depicted thereupon distinguishing each of the thirty-six stake squares, said one or two additional stake squares also having a different digital informational mark distinguishing each of the additional stake squares, using mark "0" for the stakes simulating a European roulette game or marks "0" and "00" for the stakes simulating an American roulette game, the stake squares also including twelve Zodiac signs, a Zodiac sign is placed only on each stake square depicting a prime number wherein stake squares depicting prime numbers 1, 2, 3, 5, 7, 11, 13, 17, 19, 23, 29 and 31 each also having a different Zodiac sing depicted thereon;

providing a flat image of a stationary roulette wheel comprising thirty-six main sectors, and one or two additional sectors all positioned to form a circle around the periphery of the roulette wheel, each of the thirty-six main sectors having a different digital information mark from 1 to 36 depicted thereupon in random sequence, and corresponding to the digital informational marks from 1 to 36 depicted on the thirty-six stake squares, and each additional sector having a different digital information mark corresponding to the digital information marks placed on the additional stake squares, the main sectors also including twelve Zodiac signs, a Zodiac sign is placed only on each main sector depicting a prime number wherein the twelve main sectors depicting prime numbers 1, 2, 3, 5, 7, 11, 13, 17, 19, 23, 29 and 31 each having a different Zodiac sign, each of the thirty-six main sectors also including two images of the face of the die marked from one to six dots, the thirty-six main sectors divided into six similar groups, a first group of six main sectors containing the first image of the die face with one dot, the second group of six main sectors containing the first image of the die face with two dots, the third group of six main sectors containing the first image of the die face with three dots, the fourth group of six main sectors containing the first image of the die face with four dots, the fifth group of six main sector containing the first image of the die face with five dots, the sixth group of six main sectors containing the first image of the die face with six dots; and the second image of the die face in each group of six main sectors formed as a sequence of the die faces, beginning from the image of the die face with one dot and ending in the image of the die face with six dots, wherein each of the thirty-six main sectors depicting two images of die faces representing one of the thirty-six possible combinations of two images dice faces, wherein all thirty-six possible combinations of two images of dice faces are depicted on the roulette wheel;

the croupier having chosen one or two so called "casino's numbers", i.e. number from 1 to 36, one "casino's number" for the stakes for the European roulette game, and two "casino's numbers" for the stakes for the American roulette game, the choice of the "casino's numbers" is to be made at random;

each player placing bets on selected stake squares of the stake field, including stake squares with Zodiac signs chosen by the player in accordance with particular astrological interpretations, e.g. player's birthday;

prior to the first rolling of the two hexahedral dice the croupier and the players agree as to which of the dice would refer to a particular sequence of the dice faces depicted on the main sectors of the roulette field;

rolling the two hexahedral dice a first time to yield a first combination to two images of dice faces depicted on the main sectors of the roulette field, rolling the two hexahedral dice a second time to yield a second combination of two images of dice faces depicted on the main sectors of the roulette field;

determining a winner in case of the European roulette game; if the first rolling has yielded the said combination and corresponding, depicted on the main sectors on the roulette field number except the "casino's number", the second rolling would point through the said second combination to the corresponding winning number or winning Zodiac sing for the players'; if the first rolling has yielded through the said first combination the corresponding number equal to the casino's number", and the second rolling yielded any number except the "casino's number", the winners would be those players having made their stakes to "0"; if the said first and second combinations point the number equal to "casino's number", replaying is to be followed;

determining a winner in case of the American roulette; if the first rolling has yielded the said first combination and corresponding with it any number except two "casino's numbers", the second rolling would point through the said second combination to the corresponding with it winning number or winning Zodiac sign for the players; if the first rolling has yielded through the said first combination the corresponding number equal to the first of the two "casino's number", and the second rolling yielded any number except the "casino's number", the winners would be those players having made their stakes to "0"; if the first rolling has yielded through the said first combination the corresponding number equal to the second of the two "casino's number", and the second rolling yielded any number except the "casino's number", the winners would be those players having made their stakes to "00"; if the said first and second combinations point the number equal to any of two "casino's number", replaying is to be followed or a stake "F"—"fortune" might be proposed if only two numbers equal to "casino's numbers" have been cast in succession.

* * * * *